US008037628B2

(12) United States Patent
Kaufman

(10) Patent No.: US 8,037,628 B2
(45) Date of Patent: Oct. 18, 2011

(54) MEDICINE DOSING COMPLIANCE SYSTEM

(76) Inventor: Stacy Kaufman, Sunrise, FL (US)

( * ) Notice: Subject to any disclaimer, the term of this patent is extended or adjusted under 35 U.S.C. 154(b) by 70 days.

(21) Appl. No.: 12/429,216

(22) Filed: Apr. 24, 2009

(65) Prior Publication Data

US 2009/0265967 A1 Oct. 29, 2009

Related U.S. Application Data

(60) Provisional application No. 61/047,461, filed on Apr. 24, 2008.

(51) Int. Cl.
*B42D 15/00* (2006.01)

(52) U.S. Cl. ..... 40/310; 40/312; 283/81; 283/900

(58) Field of Classification Search ..... 40/310
See application file for complete search history.

(56) References Cited

U.S. PATENT DOCUMENTS 6,860,513 B2 * 3/2005 Kaufman ..... 283/81
2004/0188998 A1 * 9/2004 Henthorn ..... 283/900

* cited by examiner

*Primary Examiner* — Casandra Davis
(74) *Attorney, Agent, or Firm* — Robert M. Schwartz

(57) ABSTRACT

An article and method for recording dosing compliance is provided having compliance recordation indicia printed on a compliance recordation article and a mechanism for attaching the article to a container.

3 Claims, 11 Drawing Sheets

24

| MARK MEDICINE USE EACH TIME YOU TAKE | | | | | | |
|---|---|---|---|---|---|---|
| SUN 3/29 | MON 3/30 | TUE 3/31 | WED 4/1 | THU 4/2 | FRI 4/3 | SAT 4/4 |
| X | X | X | ~~AM~~ | AM | AM | AM |
| X | X | ~~NOON~~ | NOON | NOON | NOON | NOON |
| X | X | ~~PM~~ | PM | PM | PM | PM |
| X | X | ~~BED~~ | BED | BED | BED | BED |
| SUN 4/5 | MON 4/6 | TUE 4/7 | WED 4/8 | THU 4/9 | FRI 4/10 | SAT 4/11 |
| AM | AM | AM | AM | AM | AM | AM |
| NOON | NOON | NOON | NOON | NOON | NOON | NOON |
| PM | PM | PM | PM | PM | PM | PM |
| BED | BED | BED | BED | BED | BED | BED |
| SUN 4/12 | MON 4/13 | TUE 4/14 | WED 4/15 | THU 4/16 | FRI 4/17 | SAT 4/18 |
| AM | AM | AM | AM | AM | AM | AM |
| NOON | NOON | NOON | NOON | NOON | NOON | NOON |
| PM | PM | PM | PM | PM | PM | PM |
| BED | BED | BED | BED | BED | BED | BED |
| SUN 4/19 | MON 4/20 | TUE 4/21 | WED 4/22 | THU 4/23 | FRI 4/24 | SAT 4/25 |
| AM | AM | AM | AM | AM | AM | AM |
| NOON | NOON | NOON | NOON | NOON | NOON | NOON |
| PM | PM | PM | PM | PM | PM | PM |
| BED | BED | BED | BED | BED | BED | BED |
| SUN 4/26 | MON 4/27 | TUE 4/28 | WED 4/29 | THU 4/30 | FRI 5/1 | SAT 5/2 |
| AM | AM | AM | AM | AM | AM | AM |
| NOON | NOON | NOON | NOON | NOON | NOON | NOON |
| PM | PM | PM | PM | PM | PM | PM |
| BED | BED | BED | BED | BED | BED | BED |

FIG.13

MEDICINE DOSING COMPLIANCE SYSTEM

INDEX TO RELATED APPLICATIONS

This application claims the benefit of U.S. Provisional Patent Application No. 61/047,461, filed Apr. 24, 2008, the disclosure of which is incorporated herein by reference in its entirety.

BACKGROUND OF THE INVENTION

Compliance when taking any product that is to be administered over a period of time is always a major concern. When the compliance relates to a patient compliance of a medical dosing regimen, the concerns for compliance are heightened. The present invention addresses the need for an effective article and method for assisting patient compliance.

BRIEF SUMMARY OF THE INVENTION

The present invention is a label configured to be secured to a prescription bottle or other container in which dosing and compliance are important. The label has indicia for specific days and times in which the medicine should be taken.

By way of example, if a patient has a prescription filled on Monday January 14 with instructions for the medicine to be taken three times a day for five days, the label may read as follows:

| | a.m. | p.m. | night |
|---|---|---|---|
| Monday, Jan. 14, 2008 | ___ | ___ | ___ |
| Tuesday, Jan. 15, 2008 | ___ | ___ | ___ |
| Wednesday, Jan. 16, 2008 | ___ | ___ | ___ |
| Thursday, Jan. 17, 2008 | ___ | ___ | ___ |
| Friday, Jan. 18, 2008 | ___ | ___ | ___ |

The area after each day would be for the patient to indicate or mark the dosage for that day and/or the time the dosage had been taken.

The indicia would change based on the dosing regimen prescribed and dates, but would be automatically generated for a label based upon the dosing regimen prescribed.

In a preferred embodiment the present invention is an article for recording dosing compliance comprising:

a. compliance recordation indicia printed on a compliance recordation article; and b. attaching the article to a container.

The dosing regimen may be a prescription or non-prescription medicinal product, a nutraceutical, a nutritional supplement and the like.

The dosing regimen may be a schedule of taking a prescription or non-prescription medicinal product, a nutraceutical, a nutritional supplement and the like under the direction of a physician, health care provider, or as directed by a distributor or manufacturer of a product.

The article indicia are customizable to a dosing regimen.

The customization may include specific days and times. The indicia are configured for marking dose compliance.

The indicia are marked contemporaneously with the administration of a dose by a marking letter "x", a circle, a square, and the like, other markings, and/or combinations thereof.

In one embodiment, the article is in a unitary configuration with a container label. That is, the label is affixed to the container and the article is a contiguous extension of the label.

Alternatively, the article may have a mechanism for attaching to a container which may be an adhesive that secures the article, in a permanent or substantially permanent manner to the container or to another label attached to the container.

In one embodiment, the article has a releasable adhesive on one portion of the article such that the article may be closed and conceal the recordation indicia. Preferably, the closing will be along a predefined fold line.

The present invention also comprises a method for recording dosing compliance comprising the steps of:

a. providing a compliance recordation article with compliance recordation indicia;

b. attaching the article to a container;

c. dispensing a dose from the container pursuant to a dosing regimen;

d. marking the compliance recordation article with a mark indicating a time a dose was taken.

The present invention also includes a method of producing a compliance recordation article having the steps of:

a. providing a customizable computer readable medium unique for a patient and a medication;

b. operatively associating at least one user computer with said computer readable medium;

c. inputting dosage and medication information unique to a patient and into said user computer;

d. providing an output that produces a dosage compliance article;

e. affixing said dosage compliance article to a medicinal container;

f. providing said container to a patient.

BRIEF DESCRIPTION OF THE DRAWINGS

FIG. 13 is a front view of an alternate compliance label with days and times with user markings.

DETAILED DESCRIPTION OF THE PREFERRED EMBODIMENTS

Figure 2:
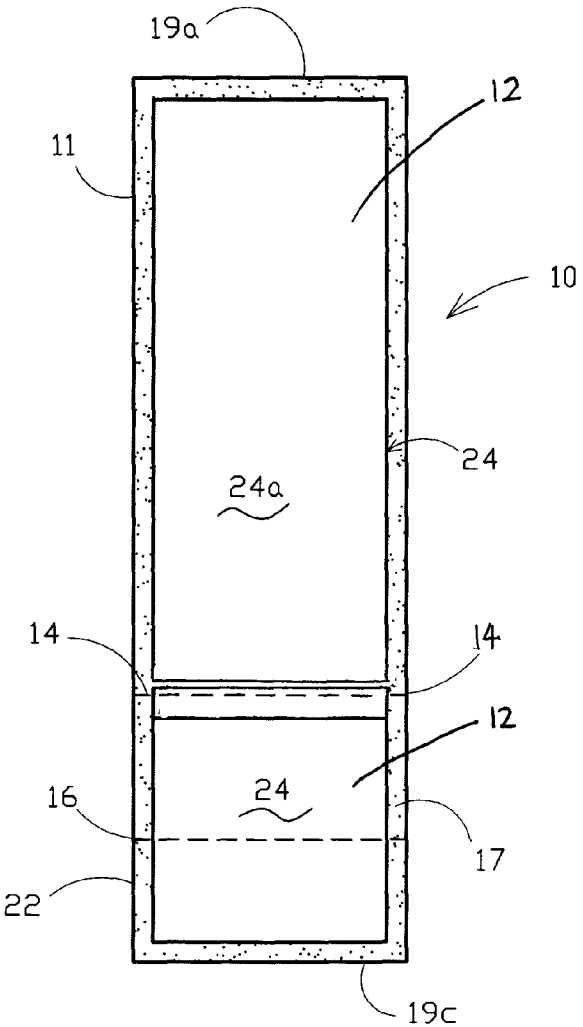
FIG. 2 is a rear view of a prescription label with a compliance calendar label.
Figure 1:
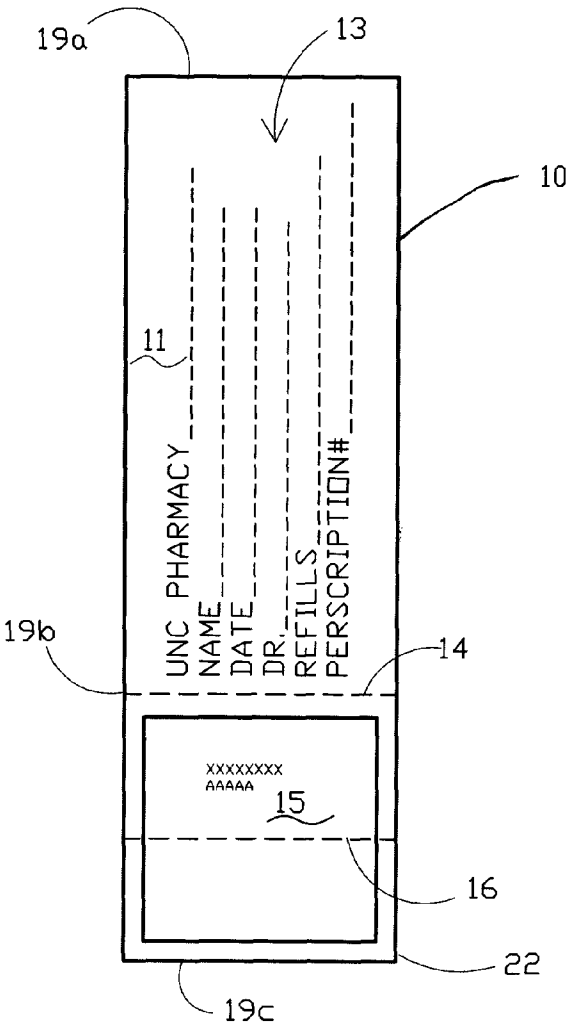
FIG. 1 is a front view of a prescription label with a compliance calendar label.
Figure 3:
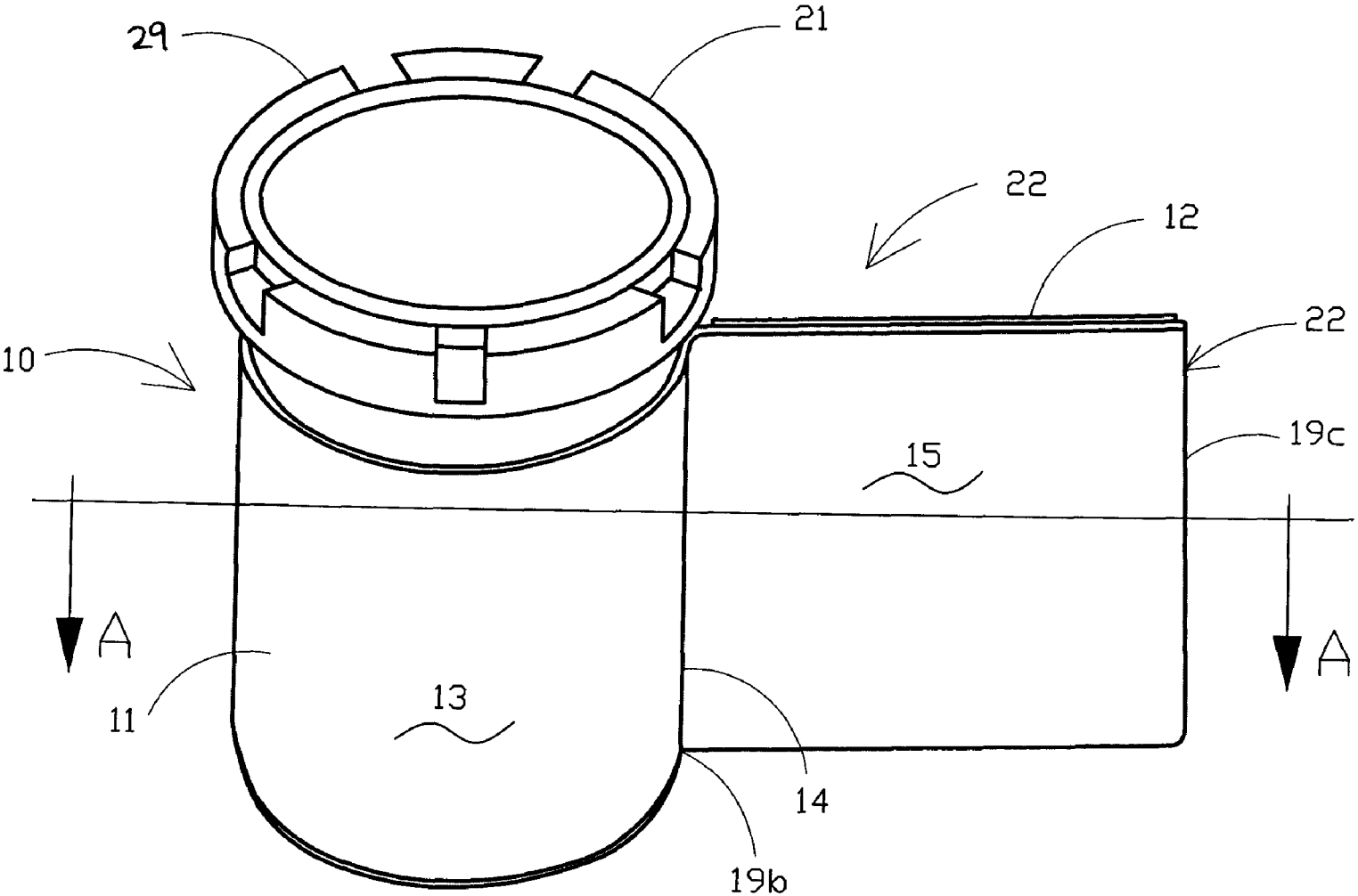
FIG. 3 is perspective view of the front of a compliance label affixed to a container.
Figure 4:
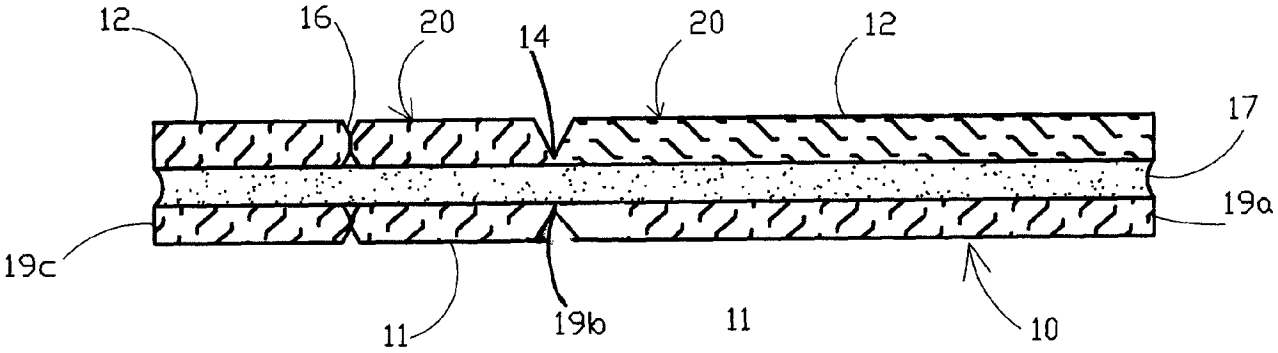
FIG. 4 is a cross section view of the prescription label of FIGS. 1 and 2 with a fold line 16.
Figure 5:
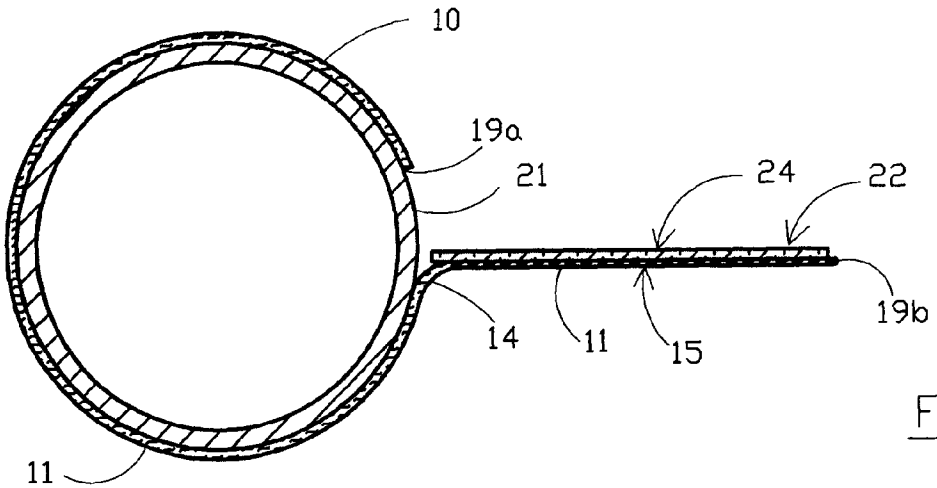
FIG. 5 is a cross section view along line A-A from FIG. 3.

The present invention is a compliance calendar label for monitoring patient compliance and a dosing regimen.

Pharmaceutical label 10 is formed from a label sheet or roll as known in the art and has a front face 11. Label 10 is an adhesive label, having a layer of adhesive 17 generally behind said label 10. A silicon liner 20 provides a protective cover over said adhesive 17. Silicon liner 20 has a rear label face 12.

Front face 11 includes printed thereon a prescription in a prescription area 13 and a first compliance indicia area 15. Rear face 12 includes printed thereon a second compliance indicia area 24. Label 10 has a score line 14. Said score line is also on liner 20. In one embodiment, areas 15 and 24 have a fold line 16.

Label 10 is affixed to a container 21 by removal of a portion of liner 20, the portion 24*a* at score line 14, and exposing adhesive 17 for affixing reverse side of label 10 circumferentially around container 21. Said container 21 having a top rim 29 for receiving a closure cap not shown. Label 10 is constructed and arranged to be wrapped circumferentially around the perimeter of a desired container 21 starting at first end 19*a* of label 10 to second end 19*b* of label 10. An informational tab 22 is formed approximately from score line 14 to the end of label 10 at tab end 19*c*. Patient compliance indicia can be printed on one or both sides of tab 22 on compliance indicia areas 15 and 24. Understandably, label 10 could be rearranged with the compliance indicia areas in different locations on label 10.

The rear of label 10 includes a liner 24 that is typically scored at one or more locations. In at least a first location at the base of tab 22 at score line 14 and at a fold line 16 of tab 22. Score 14 provides a fold line for face 11 and a tear line for face 12 to easily detach liner portion 24*a*. Label 10, as known in the art, and manufactured by Rx Technology Corporation, Joplin, Md. 64801, may be taken either from a label sheet that is passed through a printer and then removed or label 10 may be on a roll of labels attached end to end that are thermally printed and the label is then detached from the roll.

Figure 6:
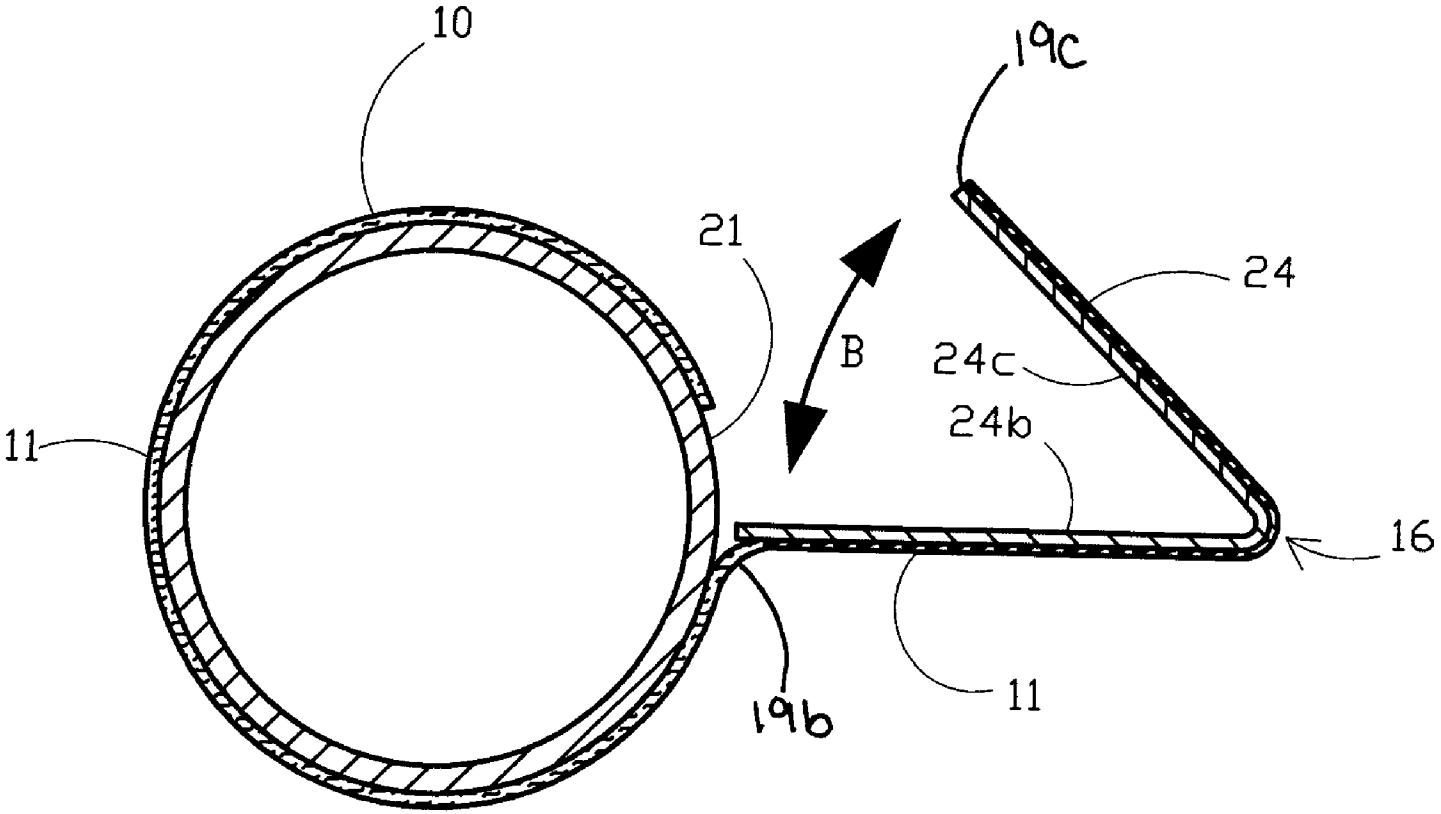
FIG. 6 is a cross section view of a compliance label on a container with an open tab.
Figure 7:
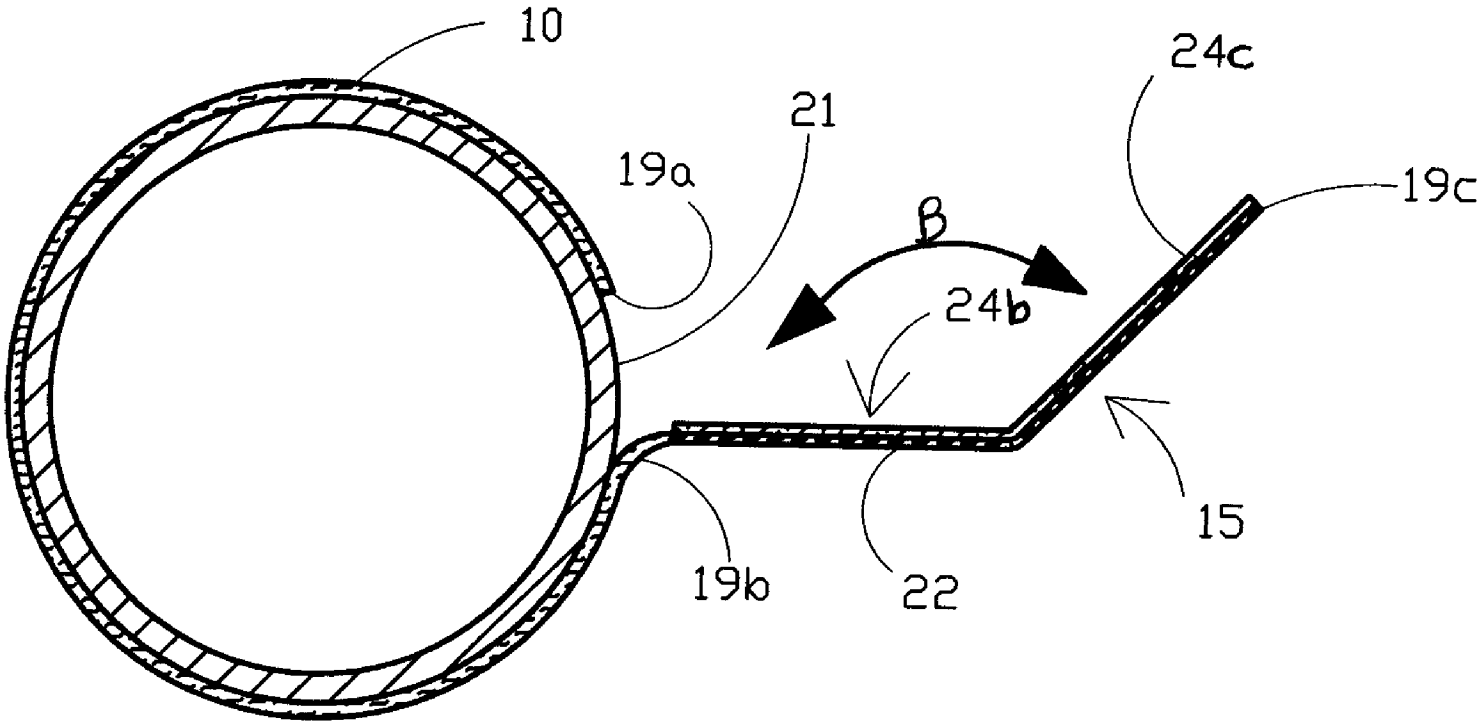
FIG. 7 is a cross section view of a compliance label with the tab open.
Figure 8:
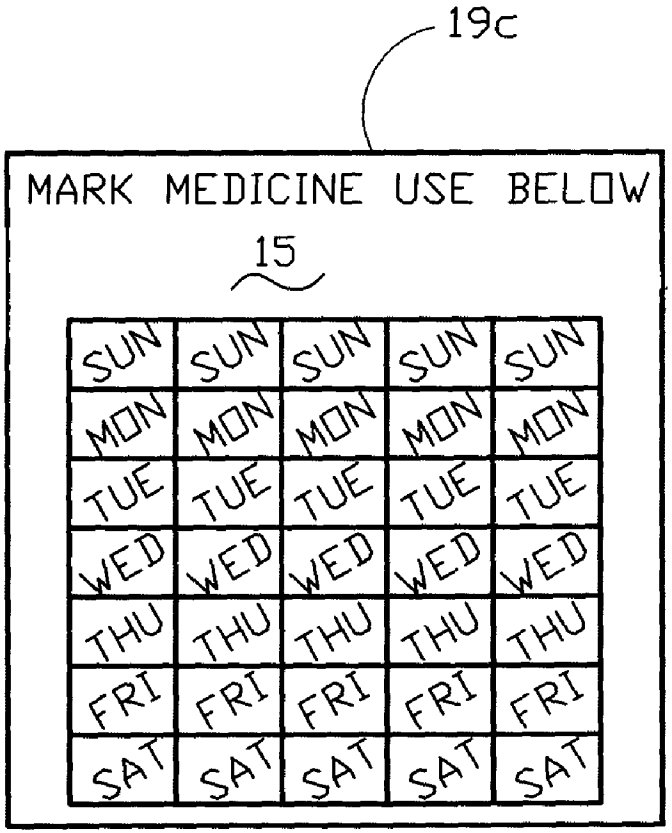
FIG. 8 is a front view of a generic compliance label.

Tab 22 can be folded back onto itself as shown in FIGS. 6 and 7. Tab 22 folds in the directions—back and forth—depicted by arrow B such that a hinge is created at fold line 16 such that compliance indicia 24*a* folds back on itself. Edge portion of adhesive 17 releasably secures a first portion 24*b* of indicia area 24 against a second portion 24*c* of indicia area 24 one to the other.

Figure 9:
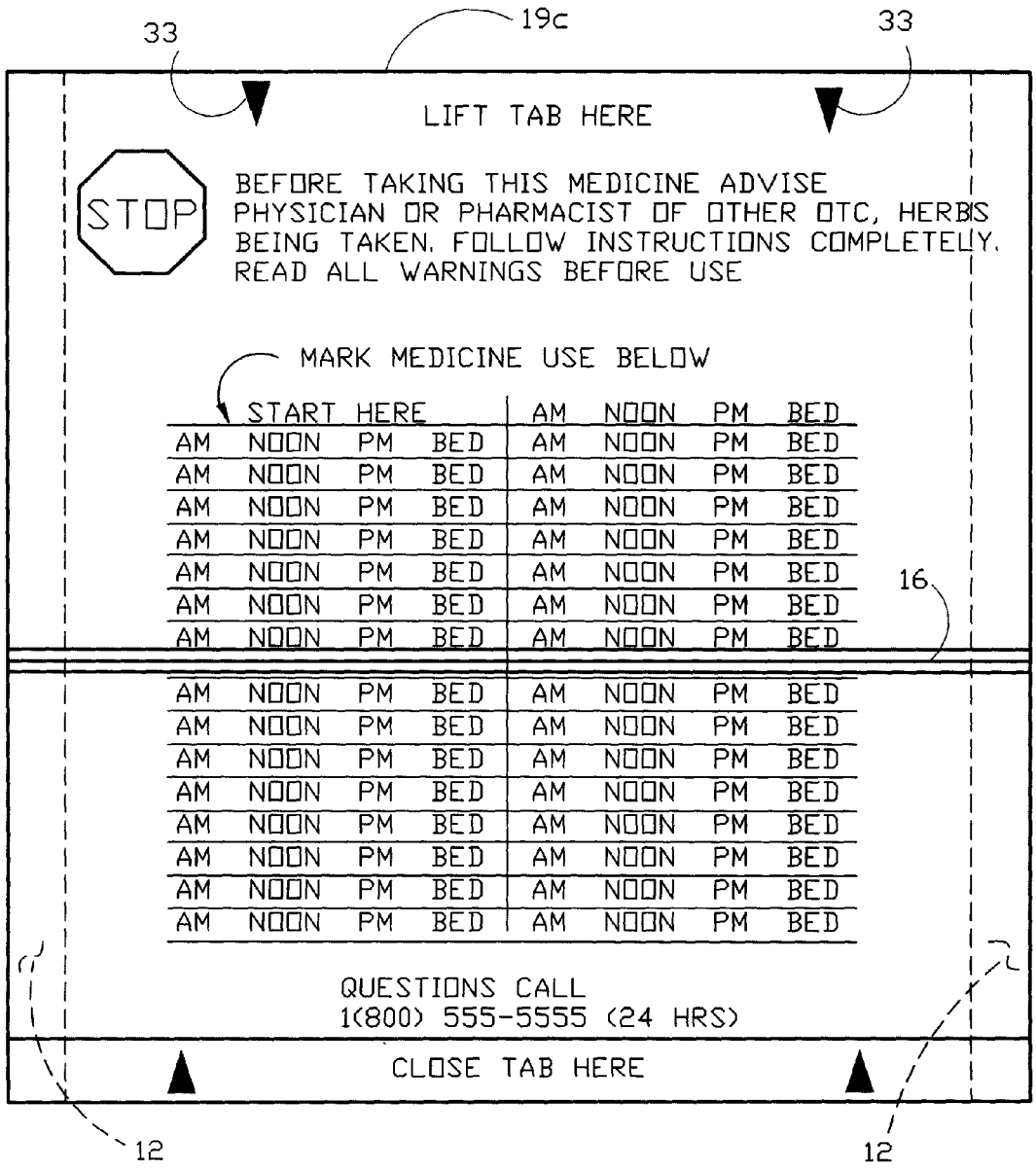
FIG. 9 is a front view of an alternate generic compliance label.
Figure 10:
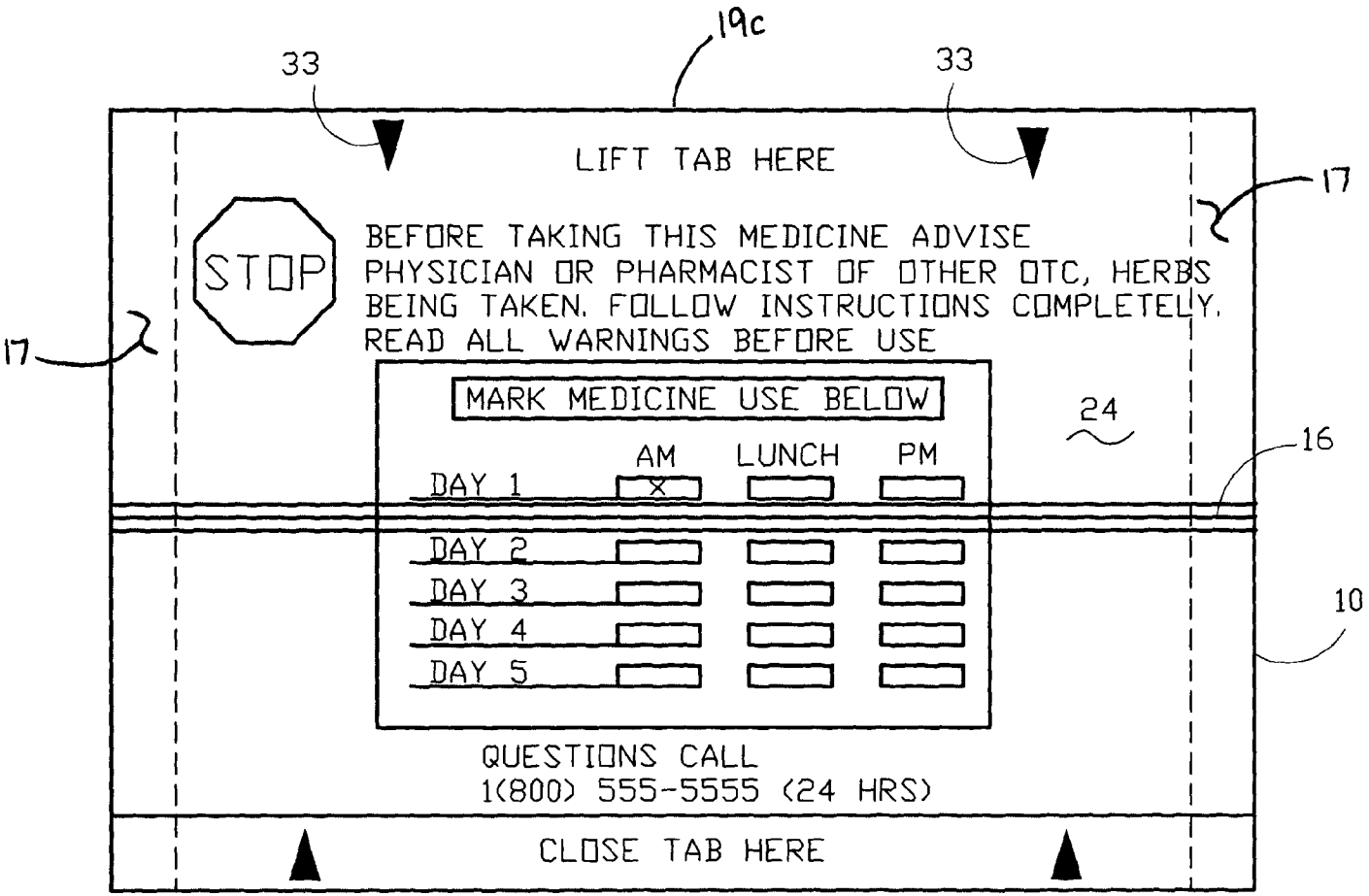
FIG. 10 is a front view of another alternate generic compliance label with a user marking.
Figure 11:
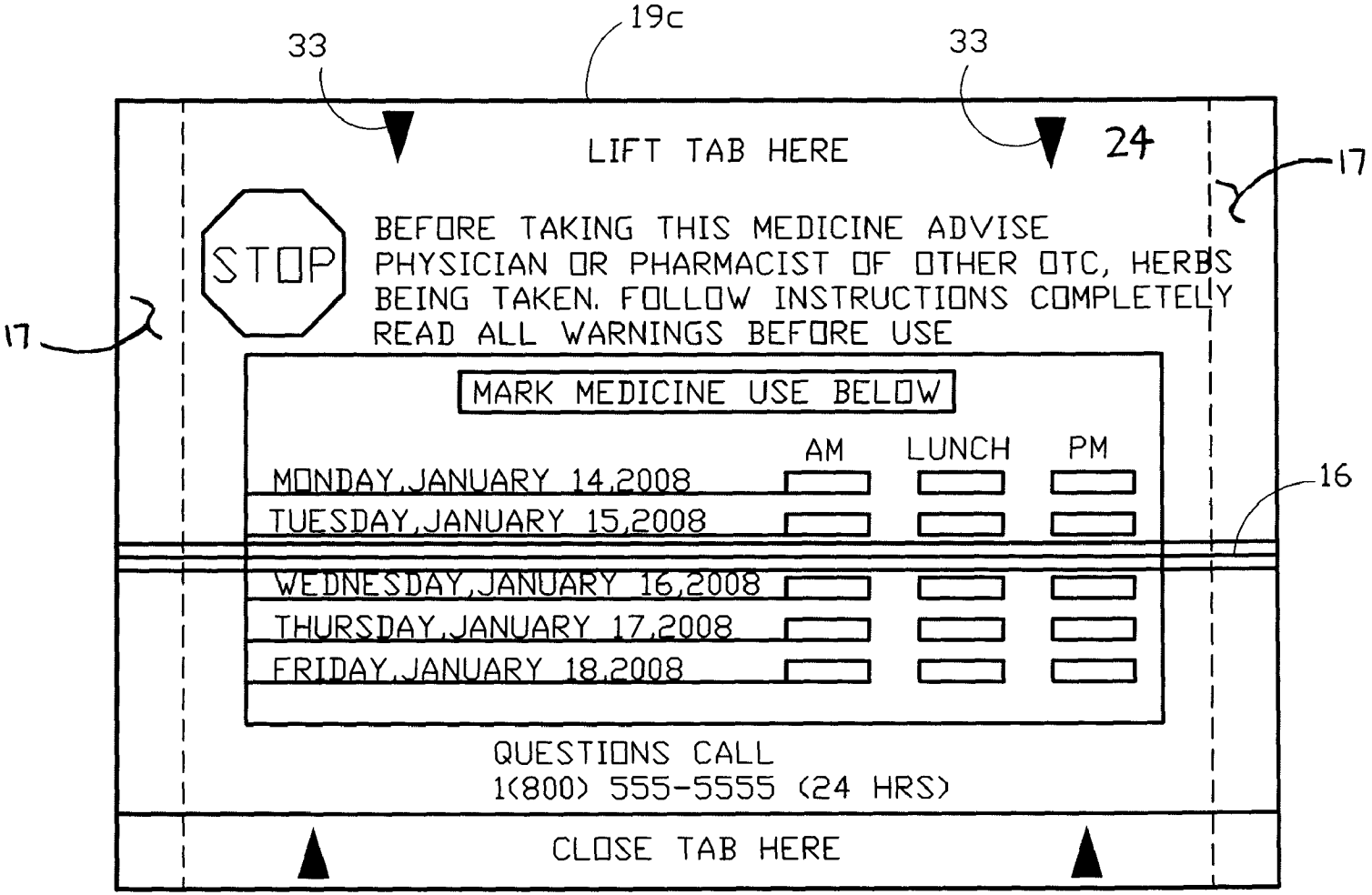
FIG. 11 is a front view of a compliance label with dates and times.

In the compliance label embodiments of FIGS. 9, 10 and 11 compliance indicia area 24 is surrounded at least on 2 side edges with adhesive 17 exposed such that compliance indicia area 24 when folded along fold line 16 as seen in FIGS. 6 and 7 will fold against itself and is released by lifting tab end 19*c* at release points 33.

The present invention provides for compliance indicia to be disposed on label 10 affixed to container 21 at the front face 11 and/or rear face 12. Preferably, the compliance indicia are a compliance calendar disposed on tab 22 that extends outward from the perimeter of container 21 to which an incorporated label 10 is formed a part thereof or is attached. Compliance calendar labels in indicia areas 15 and/or 24 of the present invention are marked manually by a user. The user typically being the patient taking the medication or a person administering the medication for the patient. The marking does not require any electronics to keep track of dosing. The manual marking is by pencil, pen, hole puncher, combinations thereof, or any other appropriate marking mechanism. The compliance calendar to be marked is at the site of dispensing the medicine to the patient either by the patient directly or by a person administering it to the patient.

The compliance calendar is presented as either a generic listing of days and dosing times, as is shown in FIGS. 8, 9, 10 and 12 or may be presented to a particular patient with days and times specific to a patient dosing regimen, as in FIGS. 11 and 13.

By way of example, and not limiting thereby, a patient is directed to take a particular medication twice a day, that has a prescription dispensed at a pharmacy beginning on Apr. 1, 2009 at 6 p.m. The patient would not have a morning dose but only an evening dose. As seen below, the morning dose on Apr. 1, 2009 has been marked indicating no morning dose. A personal compliance calendar that begins:

| | | |
|---|---|---|
| Apr. 1, 2009 | XXX | ____ p.m. |
| Apr. 2, 2009 | ____ a.m. | ____ p.m. |

The calendar would continue with subsequent dates until dosing regimen is completed.

Figure 12:
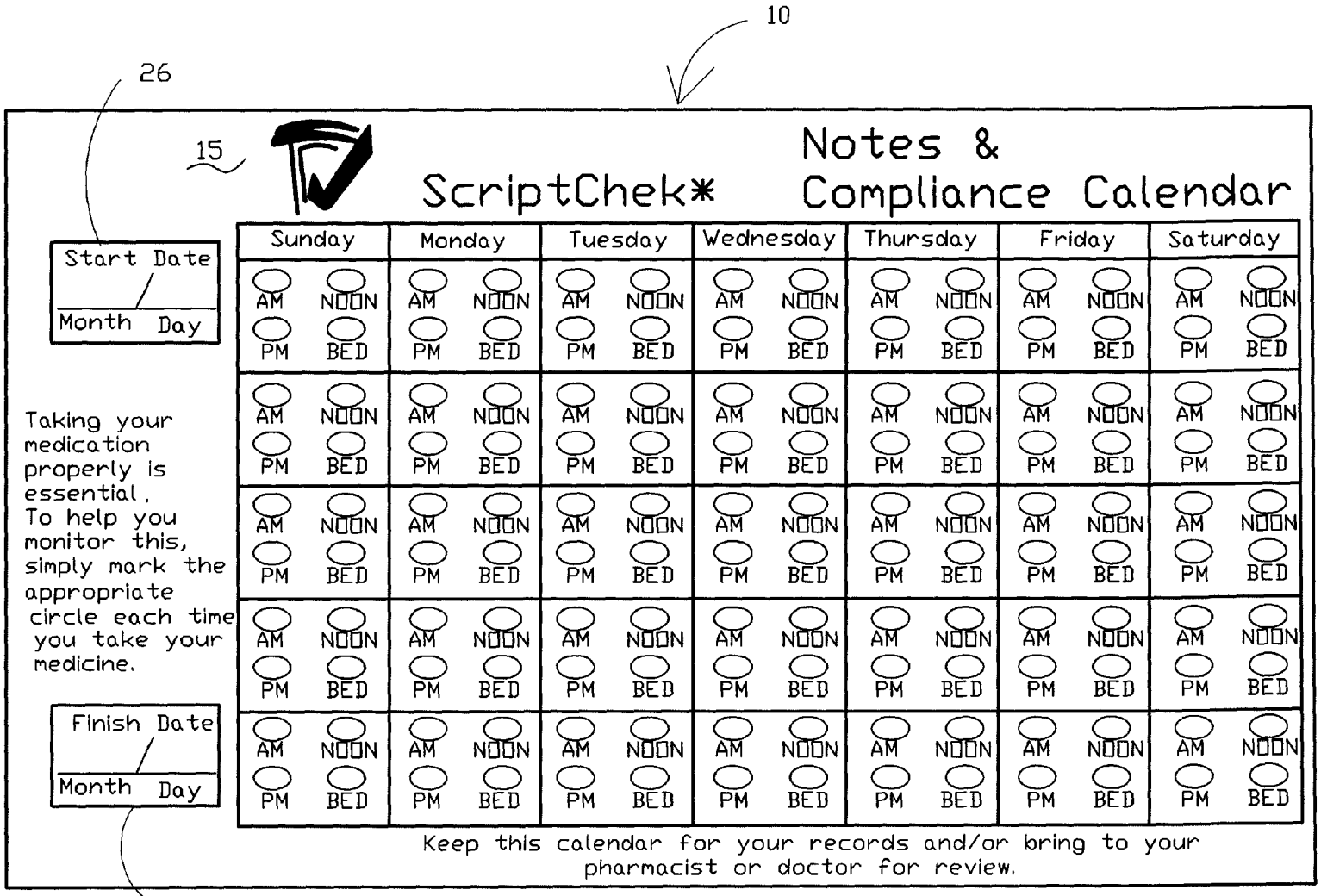
FIG. 12 is a front view of an alternate compliance label with days and times.

The compliance calendar of the present invention will have indicia for particular start dates 26 and end dates 27 as applicable to a particular patient and medication, see FIG. 12.

In the above example, the personal compliance calendar indicates only one dosage to be taken on Apr. 1, 2009 with subsequent days if applicable (only April $2^{nd}$ shown) to be taken morning and evening. The a.m. dosage of Apr. 1, 2009 is blocked out, thus indicating to the patient that no dosage be taken on that day and time. Similarly the calendars in FIGS. 10 and 13 have been customized for the patient's prescribed dosing regimen. In FIG. 10, the Day 1 "a.m." space has been blocked out indicating no dosage to be taken on that time. The first dosage called for at Day 1 "lunch." In FIG. 13, the days and dates have been customized to a start date of noon on Tuesday March $31^{st}$ (3/31). In the top row of the compliance calendar the days March 29 and 30 have been blocked out for the times a.m., noon, p.m. and bed when the compliance label was printed. Thus indicating the start time and day of noon March $31^{st}$. Also shown in FIG. 13, are the markings by the user on March 31 for noon, p.m., bed and April 1 a.m. Said user markings indicate the compliance of the user in taking the "medicine use each time" taken.

In an example of ongoing dosing, such as, but not limited to blood pressure medication that is taken continually every day, the personal compliance calendar is presented to the patient with date and time indicia indicative of either an initial prescription, or date and time indicia indicative of when a previous prescription supply is exhausted and a new prescription supply begins.

By way of example only, a patient dispensed an initial 30 day supply of blood pressure medication on May 1, 2009 will receive a compliance calendar indicative of dosing starting on May 1, 2009. This patient calls a pharmacy for refill and typically requests a refill before the current supply is depleted. A patient may call in a refill on May 25, 2009, and the personal compliance calendar of the refill will have indicia beginning on May 31, 2009 i.e. the day the refill begins to replace the initial 30 day supply.

A particular dosing regimen, for example, a regimen given by a physician for a medicine, is indicated e.g. printed on compliance indicia areas 15 and/or 24. In the embodiment of FIG. 10, as an example, the patient is to take a particular dosage three times a day (t.i.d—a medical abbreviation from the Latin phrase ter in die meaning a thrice-daily dosage) for five days. The patient is instructed to mark the label at the time of taking each individual dose. The present invention provides an easy way for the patient to mark the dosage taken on a particular day and time. Later, if a patient is unsure if they completed a particular dose, they need only look at label 10 on the specific container in question. As seen in FIG. 10, Day 1 "a.m." has been marked with an x.

After review of the marked doses of label 10, a patient will be able to proceed accordingly. A dose will be taken at a regimen specified time if there is no indication it had been taken. Conversely, the dose will be skipped if label 10 indicates the dose had been taken.

Although the figures show a particular embodiments with the indicia placed on one region of label 10, the compliance information may be printed on the entire compliance indicia area 15 and/or 24 of label 10 in various manners and formats. Various manners and formats are shown in FIGS. 8 to 13.

The indicia would be specific for the dosing regimen. For example, if the dosing regime called for taking a particular dose two times the first day, and once a day for six more days, the label may appear as follows noting that the afternoons after day 1 are "marked out" indicating no dosage for that period:

| | a.m. | p.m |
|---|---|---|
| Start | | |
| Day 1 | ___ | ___ |
| Day 2 | ___ | X |
| Day 3 | ___ | X |
| Day 4 | ___ | X |
| Day 5 | ___ | X |
| Day 6 | ___ | X |
| Day 7 | ___ | X |
| End | | |

As seen in FIG. 12, label 10 has indicia to accommodate many doses dispensed from a single container. Label 10 of FIG. 12 has indicia for four doses a day, seven days a week, for five weeks. This compliance calendar provides indicia for recordation of 140 individual doses of a medication from a single container.

The compliance calendars shown in FIGS. 8 to 13 may be in either compliance indicia area 15 or 24 in any combination and where only a compliance calendar is placed in either 15 or 24 then the other area 15 or 24 without a compliance calendar may contain any other information.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

I claim:

1. A device to mark the taking of medication to ensure that medication is taken appropriately, without missed doses or overdoses, said device incorporated into a label, said label being affixed substantially about the circumference of a medication bottle, said label further including a tab, said tab having a first portion and a second portion, said first portion and said second portion being each of a first length and separated by a fold line, wherein said first portion may be folded atop said second portion, and further said first portion having a first side and a second side, wherein said first portion first side includes indicia which when filled by a mark designates medication use, such that the patient upon taking the medication places said mark on the appropriate area on said indicia which indicates that the medication has been taken and said first portion second side also includes indicia designed to indicate medication use, said medication use indicated by the patient marking an appropriate area on said indicia therefore indicating that the medication has been taken.

2. A device to mark the taking of medication to ensure that medication is taken appropriately, without missed doses or overdoses, said device incorporated into a label, said label being affixed substantially about the circumference of a medication bottle, said label further including a tab, said tab having a first portion and a second portion, said first portion and said second portion being each of a first length and separated by a fold line, wherein said first portion may be folded atop said second portion, and further said first portion having a first side and a second side, wherein said first portion first side includes indicia which when filled by a mark designates medication use, such that the patient upon taking the medication places said mark on the appropriate area on said indicia which indicates that the medication has been taken;

wherein said second portion further includes a first side and a second side, said second portion first side includes indicia representing a calendar, said calendar including indicia indicating a number of days equal to an amount of medication present in said medication bottle, said number of days further broken down in to portions of days, whereby the patient may mark sequentially on said calendar indicia in order to indicate that the medication has been taken at the appropriate said portion of the day; and wherein said tab may be folded and unfolded as it is marked and said tab provided with an adhesive with low tackiness to permit said tab when folded to be adhesively placed about an area about said circumference of said medication bottle.

3. A device to mark the taking of medication to ensure that medication is taken appropriately, without missed doses or overdoses, said device incorporated into a label, said label being affixed substantially about the circumference of a medication bottle, said label further including a tab, said tab having a first portion and a second portion, said first portion and said second portion being each of a first length and separated by a fold line, wherein said first portion may be folded atop said second portion, and further said first portion having a first side and a second side, wherein said first portion first side includes indicia which when filled by a mark designates medication use, such that the patient upon taking the medication places said mark on the appropriate area on said indicia which indicates that the medication has been taken;

wherein said tab may be folded and unfolded as it is marked and said tab provided with an adhesive with low tackiness to permit said tab when folded to be adhesively placed about an area about said circumference of said medication bottle.

* * * * *